US012529224B2

(12) United States Patent
Navon

(10) Patent No.: US 12,529,224 B2
(45) Date of Patent: Jan. 20, 2026

(54) CURTAIN WALL CONSTRUCTION SYSTEM AND METHOD

(71) Applicant: Ram Navon, Nir-Akiva (IL)

(72) Inventor: Ram Navon, Nir-Akiva (IL)

( * ) Notice: Subject to any disclaimer, the term of this patent is extended or adjusted under 35 U.S.C. 154(b) by 299 days.

(21) Appl. No.: 18/023,310

(22) PCT Filed: Aug. 25, 2021

(86) PCT No.: PCT/IL2021/051041

§ 371 (c)(1),
(2) Date: Feb. 24, 2023

(87) PCT Pub. No.: WO2022/044008

PCT Pub. Date: Mar. 3, 2022

(65) Prior Publication Data

US 2023/0304285 A1 Sep. 28, 2023

Related U.S. Application Data

(60) Provisional application No. 63/070,288, filed on Aug. 26, 2020.

(51) Int. Cl.
*E04B 2/96* (2006.01)

(52) U.S. Cl.
CPC ..... *E04B 2/967* (2013.01)

(58) Field of Classification Search
CPC ..... E04B 2/967
See application file for complete search history.

(56) References Cited

U.S. PATENT DOCUMENTS

| | | | | |
|---|---|---|---|---|
| 3,566,561 A * | 3/1971 | Tozer | ..... | F16B 12/50 D25/123 |
| 9,663,946 B2 | 5/2017 | Frederick | | |
| 10,858,820 B2 * | 12/2020 | Navon | ..... | E04B 7/045 |
| 2009/0007520 A1 * | 1/2009 | Navon | ..... | E04B 7/045 52/837 |

FOREIGN PATENT DOCUMENTS

| | | | | |
|---|---|---|---|---|
| EP | 0686735 B1 * | 7/1999 | | |
| GB | 2304365 A * | 3/1997 | ..... | E04D 3/08 |
| JP | H09317335 A | 12/1997 | | |
| KR | 200442752 Y1 * | 12/2008 | | |
| KR | 20180100936 A | 9/2018 | | |

OTHER PUBLICATIONS

International Search Report and Written Opinion issued in related PCT Application No. PCT/IL2021/051041 mailed Dec. 9, 2021, 10 pages.

* cited by examiner

*Primary Examiner* — Joshua K Ihezie
(74) *Attorney, Agent, or Firm* — Rimon Law, P.C.

(57) ABSTRACT

A curtain wall construction system comprises a plurality of interconnected curtain wall supporting beams; one or more elongated and compressible sealing elements attached to at least one of the curtain wall supporting beams, wherein the curtain wall construction system is configured with a dedicated interspace within which a corresponding set of one or more rigid and impermeable panels is introducible. The curtain wall construction system further comprising a linearly displaceable clamping element that is clampable against the introduced set of panels to form a clamping arrangement which provides sealing protection in conjunction with the one or more sealing elements.

8 Claims, 18 Drawing Sheets

CURTAIN WALL CONSTRUCTION SYSTEM AND METHOD

CROSS-REFERENCE TO RELATED APPLICATIONS

This application is a national stage of International Application No. PCT/IL2021/051041, filed on Aug. 25, 2021, which claims benefit of U.S. Provisional Patent Application No. 63/070,288, filed on Aug. 26, 2020. The disclosures of both of the aforementioned applications are hereby incorporated by reference in their entireties.

FIELD OF THE INVENTION

The present invention relates to the field of construction. More particularly, the invention relates to a post and beam construction system, which is implemented and demonstrated in conjunction with a curtain wall.

BACKGROUND OF THE INVENTION

A curtain wall, which is generally non-structural, comprises an aluminum gridwork attached to a building structure and infilled with a plurality of glazing panels spanning several stories to provide an esthetically pleasing, all-glass appearance through which natural light penetrates and provides reduced lighting and energy costs relative to a building having fewer glazing panels.

Unfortunately, attaching a curtain wall to the previously constructed building structure is labor-intensive and consequently adds extra costs to the building process, requiring the transportation and subsequent installation of the gridwork elements and of the glazing panels.

An additional disadvantage of a curtain wall is the marginal sealing protection that it provides to the interior of the building, being subject to air, dust and water infiltration that influences air conditioning costs. As the glazing panels are affixed directly to the gridwork elements, elongated sealant material is manually applied to the accessible linear interface between a glazing panel and a gridwork element. When the applied sealant material is an elastomeric gasket, there is noticeable degradation of the gasket material due to exposure to UV radiation, leading to shrinkage and cracking. The use of a silicone sealant is usually not a long-term viable solution as a result of improper geometry and workmanship issues.

It is an object of the present invention to provide a curtain wall construction system and method by which the curtain wall construction time is significantly reduced relative to prior art practice.

It is another object of the present invention to provide a curtain wall construction system which provides long-lasting sealing protection.

Other objects and advantages of the invention will become apparent as the description proceeds.

SUMMARY OF THE INVENTION

A curtain wall construction system comprises a plurality of interconnected curtain wall supporting beams; one or more elongated and compressible sealing elements attached to at least one of the curtain wall supporting beams, wherein the curtain wall construction system is configured with a dedicated interspace within which a corresponding set of one or more rigid and impermeable panels is introducible, the curtain wall construction system further comprising a linearly displaceable clamping element that is clampable against the introduced set of panels to form a clamping arrangement which provides sealing protection in conjunction with the one or more sealing elements.

In one aspect, each of the interconnected curtain wall supporting beams is a spaced-web support member, and the clamping element includes a clamping member configured with a protruding plate which is capable of being received within an inter-web cavity between two laterally spaced webs of one of the spaced-web support members.

In one aspect, the spaced-web support member comprises has a single two-layered triangularly shaped head portion.

In one aspect, the spaced-web support member comprises a visual indicator that facilitates directing the protruding plate of a clamping member longitudinally through the inter-web cavity and towards the head portion.

In one aspect, the curtain wall construction system further comprises a coupling bracket for interconnecting two of the beams by a moment connection.

In one aspect, the clamping member is T-shaped.

In one aspect, each of the clamping members and spaced-web support members is configured with an aligning aperture for use in visually determining a final clamping alignment of the protruding plate.

In one aspect, the curtain wall construction system further comprises one or more angled connectors by which each of the spaced-web support members is connected to a main support member.

In one aspect, each of main support members has two opposed triangularly shaped head portions.

In one aspect, each of the panels is a glazing panel.

As referred to herein, a "beam" or a "composite beam", the latter comprising two pieces nested one within the other, is a rigid elongated structural member with at least one triangular and closed head portion having a flange which is generally perpendicular to the web when disposed at any convenient orientation, including a horizontal orientation, a vertical orientation when serving as a post, and an oblique orientation. A "transversal" direction means along the length of the beam. A "longitudinal" direction means the direction between a triangular head portion of a beam and another opposed portion of the beam. A "lateral" direction means the direction between the two web portions of a composite beam. The "orientation" of the beam refers to the orientation of the flange. These directional terms are also relevant to a member coupled to a beam.

The material from which the beam, clamping member, bracket and angled connector is made may be steel, aluminum or other structurally strong material.

A method for constructing a curtain wall comprises the steps of providing a clamping member with a protruding plate and a stationary spaced-web support member; attaching at least one elongated and compressible sealing element to the spaced-web support member; inserting the protruding plate of the clamping member into an inter-web cavity of the spaced-web support member to define an interspace delimited in one direction by the at least one sealing element; introducing a corresponding set of one or more rigid and impermeable panels with the interspace; and linearly displacing the protruding plate until the one or more introduced panels are sealingly clamped to provide sealing protection in conjunction with the one or more sealing elements.

In one aspect, the steps are repeated for another support member and clamping member, such that all clamped panels are coplanar.

DETAILED DESCRIPTION OF THE INVENTION

The curtain wall construction system comprises a plurality of interconnected beams to define a vertical, horizontal or oblique curtain wall of infilled glazing panels. The curtain wall construction system is configured with dedicated interspaces within each of which a set of one or more glazing panels is introducible, a sealing element attached to an element, generally stationary, delimiting the given interspace and contactable by a glazing panel, and a linearly displaceable clamping element that is clampable against the set of glazing panels to form a clamping arrangement which provides tight and long-lasting sealing protection against dust and water infiltration. The clamping element is easily manipulatable manually or by means of a mechanized device such as a robot.

Figure 1:
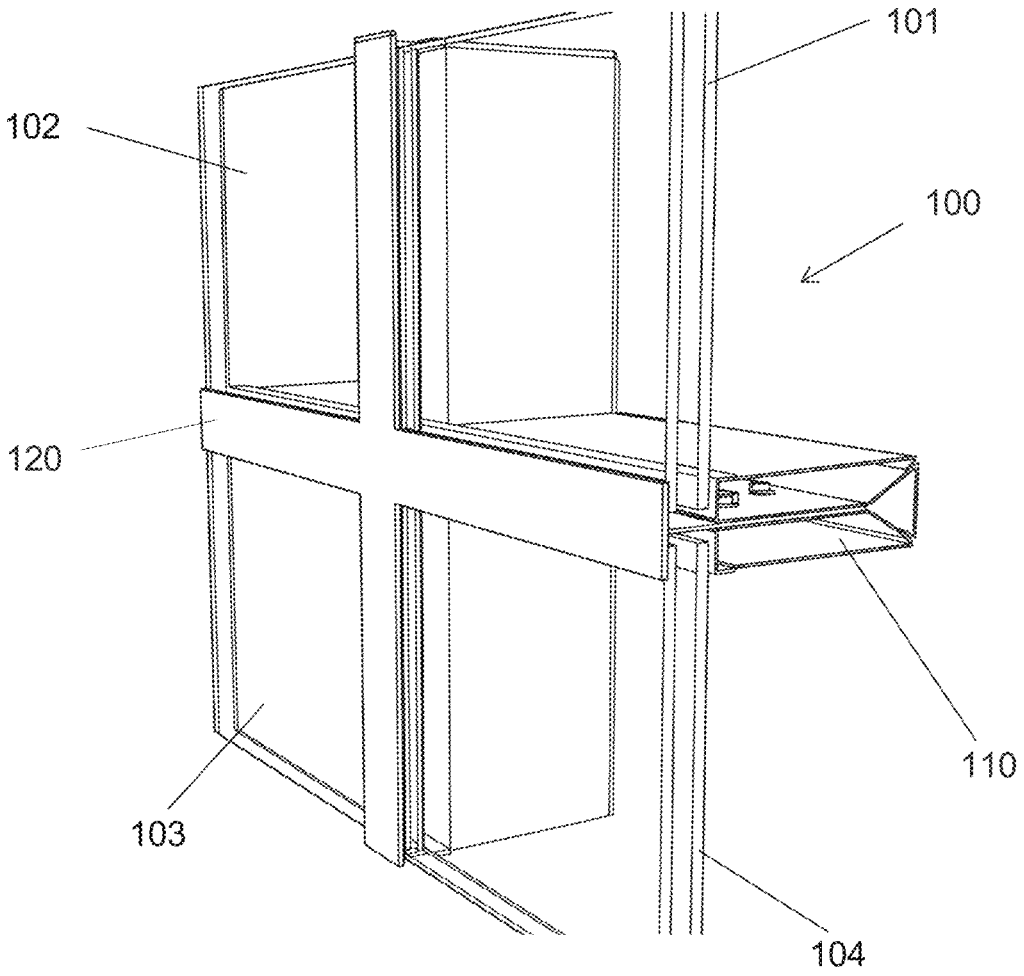
FIG. 1 is an inward perspective view of a portion of a curtain wall construction system, according to an embodiment.
Figure 3:
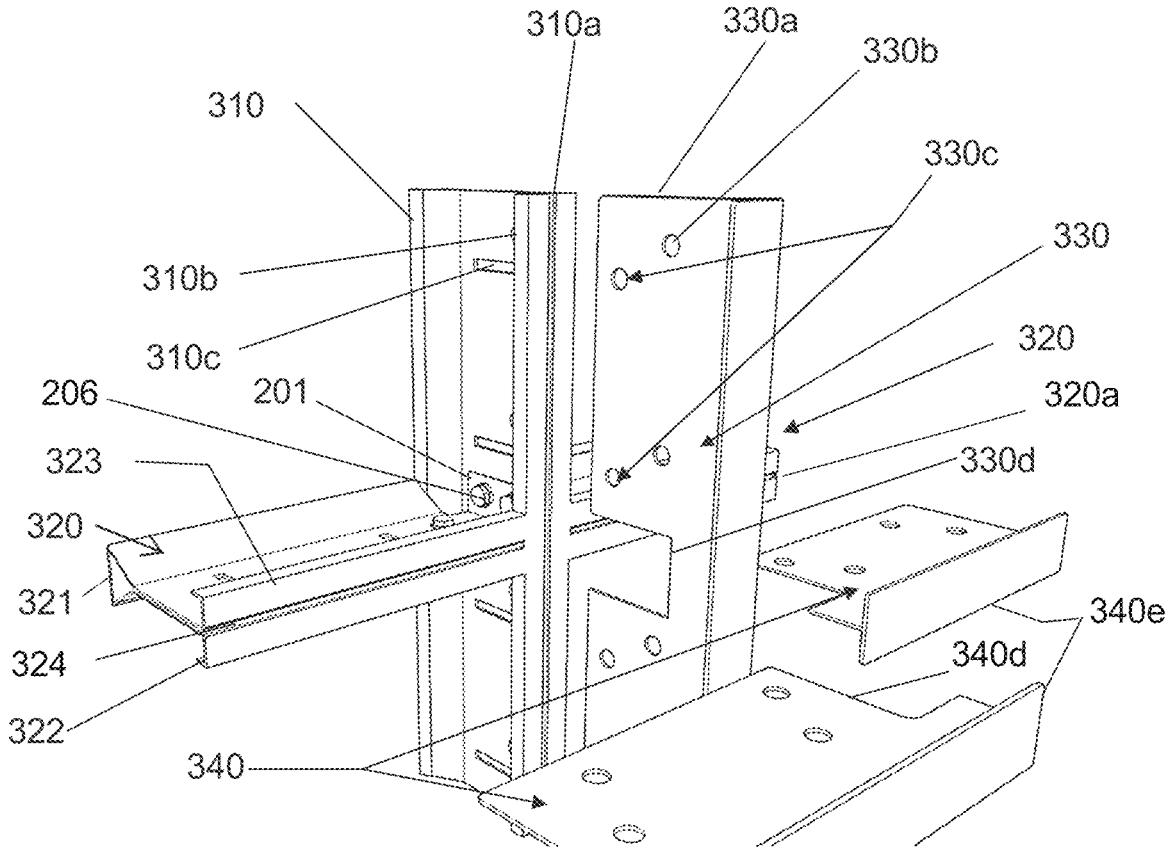
FIG. 3 is an outward perspective view of the curtain wall construction system portion of FIG. 2, showing two clamping members prior to being introduced within corresponding support members.

FIG. 1 illustrates an inward perspective view (i.e. viewed from outside a building while objects within the building are being captured) of a portion of curtain wall construction system 100, according to an embodiment, which is configured to firmly clamp four adjacent sets of double glazing panels 101-104 to vertical and horizontal support members 110, generally interconnected, by corresponding vertical and horizontal clamping members 120. As shown in FIG. 3, each of the clamping members 120 may be T-shaped. The outer glazing panel of each of the four sets, as well as of all other sets covering window openings provided at the same wall of the building, are coplanar, to provide an expansive and attractive curtain wall. Sets 101 and 102 are shown to be clamped to support members of the same floor, and sets 103 and 104 are shown to be clamped to support members of the underlying floor, although other arrangements may also be included in the invention.

It will be appreciated that other types of rigid and impermeable panels, such as aluminum and plastic panels, are suitable to be sealingly clamped by the curtain wall construction system, for use by example at a storage or logistics facility, in addition to glazing panels. On addition, the rigid and impermeable panels may be solar panels (solar panel, or photo-voltaic module, is an assembly of photo-voltaic cells mounted in a framework for installation. Solar panels use sunlight as a source of energy to generate electricity) that generate electricity while being implemented as a roof, a ceiling or sidewalls of a building.

While different types of structural element profiles may be employed as a support member 110, a preferred support member in one embodiment is the spaced-web support member 220 shown in FIG. 16, being capable of receiving the protruding plate portion of a T-shaped clamping member 120 between its spaced webs, as further explained in the following description.

Figure 16:
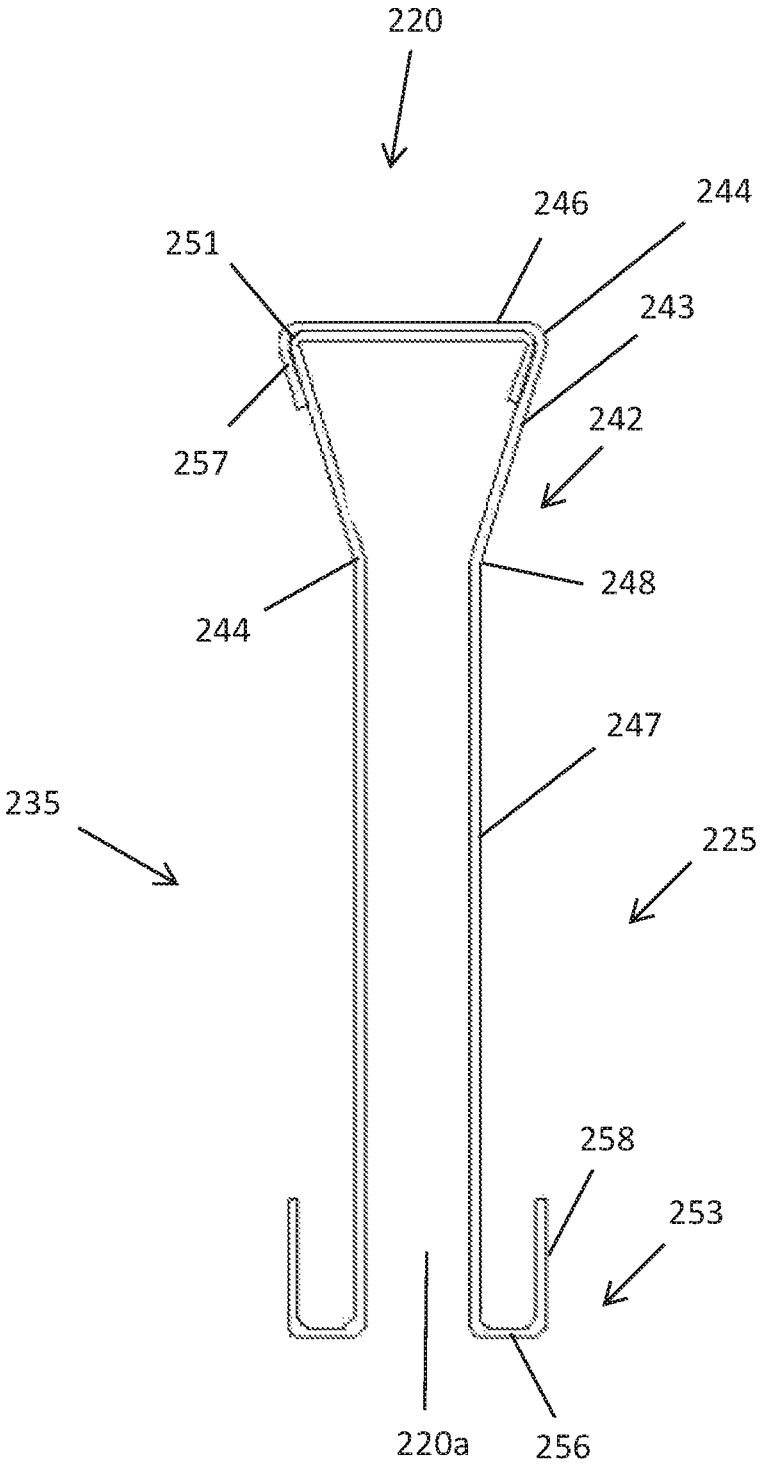
FIG. 16 is a side view of a spaced-web support member configured with a single triangularly shaped head portion which is used in conjunction with the curtain wall construction system of FIG. 1.

With reference to FIG. 16, spaced-web support member 220 in side view has a triangularly shaped head portion which provides increased lateral stability and strength to weight ratio with respect to conventional I-beams.

While some prior art beams have been configured with triangularly shaped head portions produced by a cold rolling process, these head portions are closed triangles and the third side thereof cannot be quickly and automatically shaped due to its inaccessibility and the inability of rollers to support the fed sheet metal as it is bent to form a closed triangle. In contrast, spaced-web support member 220 is a composite support member made of two separate and oppositely oriented sheet metal pieces arranged such that corresponding head portions of the two sheet metal pieces are nested one within the other. Each head portion is an incomplete triangle, so that the lip, i.e. an extremity, of a sheet metal piece is sufficiently accessible to rollers to allow the desired configuration of the sheet metal piece to be shaped. When a head portion of one sheet metal piece is nested within the corresponding head portion of the other sheet metal piece, a triangle having two-layered and therefore stiffened apices is produced. No welding is needed, and therefore the production of such a support member and the assembly of a construction system employing one or more of the support members are quicker and more economical than, and have substantially the same load-bearing capacity than, that of the prior art.

It will be appreciated that a composite support member 220 may be used not only as a beam when it is horizontally or obliquely oriented, but also as a post when it is vertically oriented. The following description applies to a beam having a horizontal orientation and a post having a vertical orientation, but all other support member orientations are also applicable.

Spaced-web support member 220 comprises two identical oppositely oriented sheet metal pieces 225 and 235 that are nested one within the other. The following description relates to sheet metal piece 225, and it will be appreciated that sheet metal piece 235 is similarly configured.

Sheet metal piece 225 has a head portion 242, a tail portion 253, and a longitudinally disposed web 247 interposed between head portion 242 and tail portion 253. Head portion 242 has an essentially laterally disposed flange 246, i.e. perpendicular to the longitudinally disposed web 247, an oblique element 243 extending from transversally extending head portion junction 244 at one lateral end of flange 246 to junction 248 interfacing with web 247, and lip 257 extending obliquely from junction 251 of flange 246 at the other lateral end thereof. Lip 257 is directed towards junction 244 interfacing with the web of sheet metal piece 235; however, its length is considerably shorter than oblique element 243. Tail portion 253 has an essentially laterally disposed shortened flange 256 extending from the end of web 247 in a direction away from sheet metal piece 235 and having a lateral dimension shorter than flange 246 of head portion 242, and terminal element 258 longitudinally extending from the end of shortened flange 256 for a length significantly less than web 247.

The angle between lip 257 and flange 246 is essentially equal to the angle between oblique element 243 and flange 246. Thus when the head portion of sheet metal pieces 225 and 235 are nested one within the other, corresponding elements of sheet metal pieces 225 and 235 are in mutual stabilizing contact, meaning that an element of sheet metal piece 225 is adapted to physically contact and to stabilize a corresponding element of sheet metal piece 235, or vice versa, when an external force is applied to support member 220 which causes insignificant relative displacement of sheet metal piece 225 with respect to sheet metal piece 235. While two elements in mutual stabilizing contact may not necessarily be in mutual physical contact, said two elements may be in physical contact during the application of an external force. Thus the mutual stabilizing contact will prevent further displacement of the displaced element. As illustrated, the pair of oblique element 243 and flange 246 of sheet metal piece 225 are in mutual stabilizing contact with the corresponding pair of the lip and flange of sheet metal piece 235 to promote stiffened apices, or rounded portions connecting two adjacent elements in the vicinity of a junction. Since support member 220 provides mutual stabilizing contact between corresponding elements of sheet metal pieces 225 and 235, the thickness of the sheet metal may be only 4 mm, requiring a relative simple cold rolling machine, yet provides the structural strength of 8-mm thick sheet metal. The sheet metal may be steel, aluminum or other structurally strong material.

The lateral length of flange 246 and the angle of oblique element 243 relative to flange 246 are selected to ensure that each web of sheet metal pieces 225 and 235, after the corresponding head portions have been nested one within the other, will remain separated from each other, to facilitate insertion of the protruding plate portion of a T-shaped clamping member or of a coupling bracket within the defined inter-web cavity 220*a* of support member 220.

While the two webs of support member 220 are laterally separated from each other, the two shortened flanges are configured to be longitudinally aligned with each other and serve as visual indicators for directing the protruding plate of a clamping member longitudinally through the inter-web cavity, in a direction towards head portion 242. The protruding plate of a coupling bracket is adapted to be inserted transversally through the inter-web cavity in a direction parallel to the width of webs 247.

Each shortened flange 256 is generally rectangular to accommodate a clamping operation performed with respect to a rectangular glazing panel as shown in FIG. 1; however, it may be configured in other ways as well. For example, an arcuate shortened flange may be used to clamp a rounded glazing panel.

Figure 2:
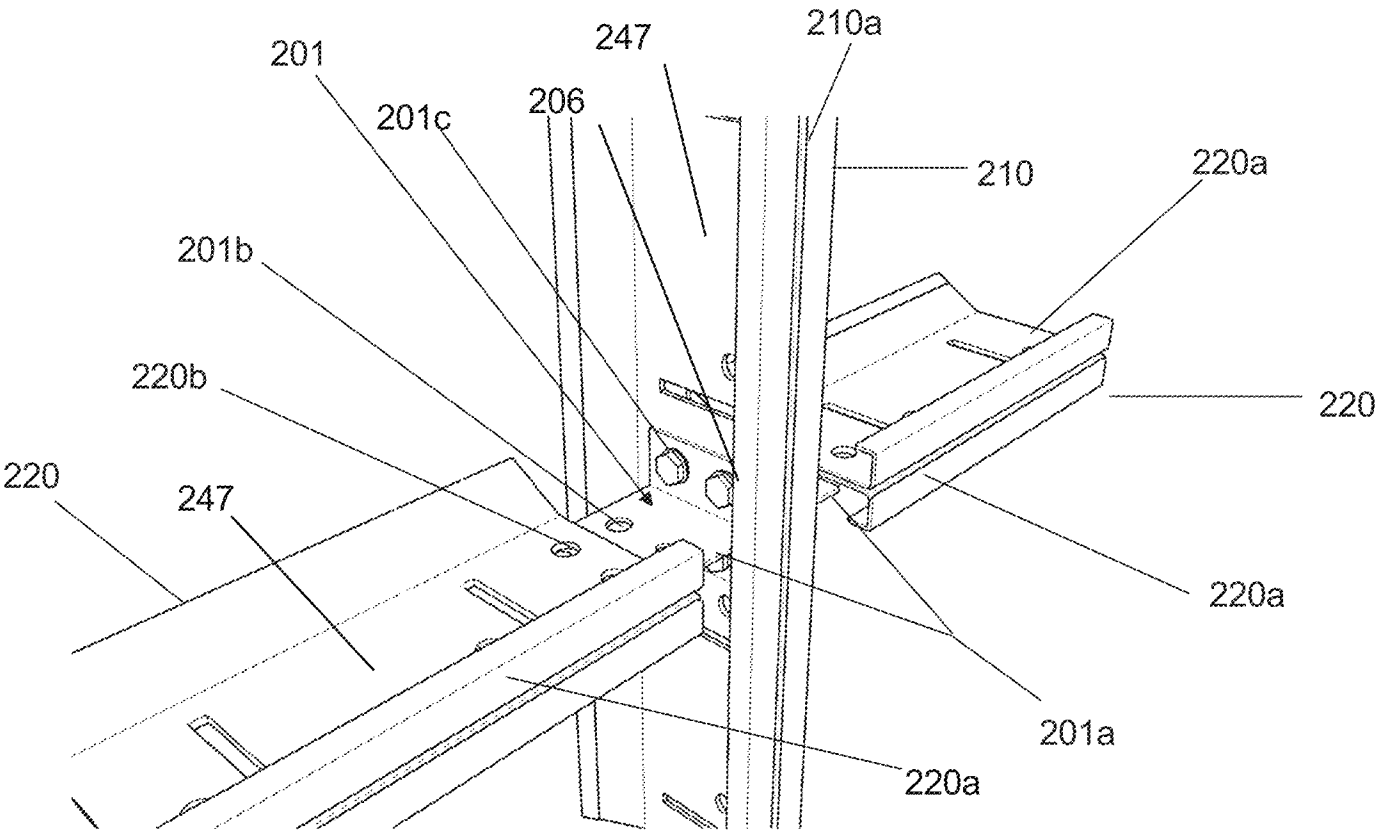
FIG. 2 is an outward perspective view of a portion of a curtain wall construction system, showing a coupling bracket used for interconnecting support members during the course of a coupling operation.

FIG. 2 illustrates an outward perspective view (i.e. viewed from the interior of the room adjacent to the curtain wall while looking outwardly) of the same curtain wall portion as that of FIG. 1 during an initial stage of assembly. Two spaced horizontally oriented support members 220 and a vertically oriented support member 210 are shown, wherein support member 210 has the same configuration in front view as each horizontally oriented support member 220. Support member 210 may vertically extend throughout the height of two or more stories of the building.

A T-shaped coupling bracket 201 is used to connect a corresponding horizontally oriented support member 220 to vertically oriented support member 210 by a moment connection. Bracket 201 has an end plate 201*c* adapted for engagement with the corresponding web 247 of vertically oriented support member 210, and a protruding plate 201*a* perpendicular to, widthwise aligned with, and extending from a central region of, end plate 201*c*.

After a fastener 206 is inserted through each pair of aligned apertures formed in end plate 201*c* of bracket 201 and in web 247 of vertically oriented support member 210 and then secured, the horizontally oriented support member 220 is selectively displaced towards vertically oriented support member 210, such as by means of a crane. The selective displacement of horizontally oriented support member 220 ensures that protruding plate 201*a* will be sufficiently received transversally within the inter-web cavity 220*a* of the corresponding horizontally oriented support member 220, until two apertures 201*b* formed in protruding plate 201*a* will be aligned with two apertures 220*b* formed in web 247 of horizontally oriented support member 220, respectively. A fastener inserted in a pair of aligned apertures and then secured maintains a firm coupling of horizontal support members 220 and vertical support members 210. Accordingly, shear forces are able to be transmitted between the web of vertically oriented support member 210 to the web of the horizontally oriented support member, resulting in reduced-magnitude moments at the moment connection.

FIG. 3 illustrates the positioning of clamping members 330 and 340 that are adapted to clamp the glazing panels, prior to a clamping operation. Each of the clamping members is T-shaped, and has a protruding plate perpendicularly extending from the end plate, for example the end plate 340*e*. Clamping member 330 is vertically oriented, and its protruding plate is adapted to be longitudinally introduced within the inter-web cavity 310*a* of support member 310. Clamping member 340 is horizontally oriented, and its protruding plate is adapted to be longitudinally introduced within the inter-web cavity 320*a* of support member 320.

Protruding plate 330*a* of clamping member 330 is configured with a central cutout section 330*d* that is suitably shaped, such as with a rectangular cutout, to avoid interference with fasteners 206 passing through each bracket 201 which interconnects support members 310 and 320 while protruding plate 330*a* is being introduced within the inter-web cavity 310*a* of support member 310. The widthwise edge of the protruding plate of each clamping member 340 closest to support member 310 is configured with a cutout section 340*d* that is suitably shaped, such as with an L-shaped cutout, to avoid interference with a corresponding protruding plate 201*a* of bracket 201 (FIG. 2), which has already been introduced within the inter-web cavity of the corresponding supporting member 320.

The web of support member 310 is formed with one or more pairs of aligning apertures 310*b* and 310*c*, which may be differently shaped. For example, aligning aperture 310*b* is shown to be circular and aligning aperture 310*c* is shown to be elongated, such as elliptical. Likewise protruding plate 330*a* of clamping member 330 is formed with one or more pairs of aligning apertures 330*b* and 330*c*, each shown to be circular. The relative location of aligning apertures 330*b* and 330*c* is selected such that they are longitudinally aligned with, when protruding plate 330*a* of clamping member 330 is inserted within the inter-web cavity of supporting member 310, the corresponding aligning apertures 310*b-c* formed in the web of supporting member 310. It will be appreciated that other aperture configurations are within the scope of the invention. Aligning apertures 310*b-c* and 330*b-c* are used for visually determining a final clamping alignment as will be described in relation to FIGS. 10 and 11.

Further shown in FIG. 3 are triangularly shaped head portion 321 and two spaced terminal elements 322 of horizontal support member 320. The outer face, i.e. the face closest to the glazing panels, of each pair of the integrally formed terminal element 322 and shortened flange 324 may be covered with a compressible sealing element 323, e.g. Teflon. Similarly, the inner face of the end plate 340*e* of clamping member 340 may also be covered with compressible sealing element 323, in order to provide an improved sealing engagement with the clamped glazing panels, as further illustrated in FIG. 10.

FIGS. 6-11 illustrate six stages, respectively, of a method for sealingly clamping a set of glazing panels positioned within a dedicated interspace with respect to a lower edge of the glazing panels. It will be appreciated that this method may also be performed with respect to side edges, or any other differently oriented edges of the glazing panels, as well as to an upper edge of the glazing panels, mutatis mutandis.

Figure 4:
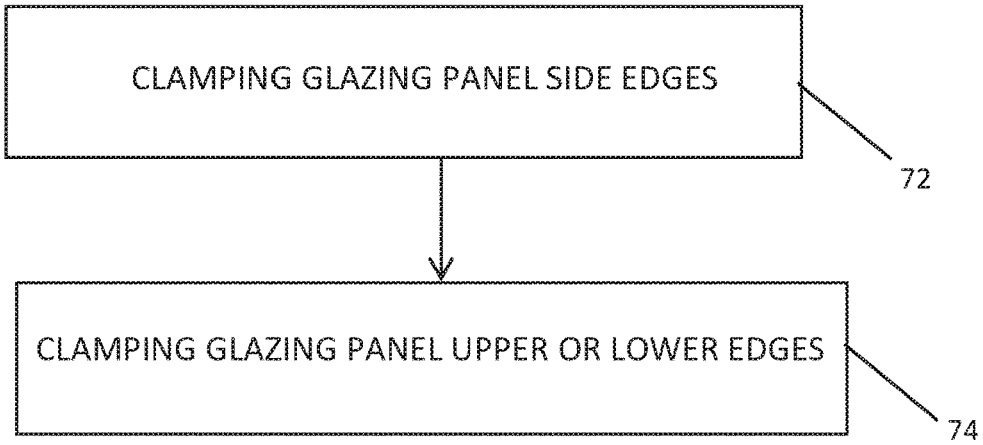
FIG. 4 is an embodiment for sealingly clamping a glazing panel.

As shown in the embodiment of FIG. 4, side edges of a glazing panel are clamped in step 72 so that the glazing panel will be suitably held in position without contacting a metallic surface delimiting an interspace within which the glazing panel is able to be inserted. Once the glazing panel is held in position by its side edges, the upper or lower edge of the glazing panel is then able to be sealingly clamped in step 74 by the six stages that will be described hereinafter. If desired, the upper and lower edges of the glazing panel may be clamped simultaneously.

Figure 5:
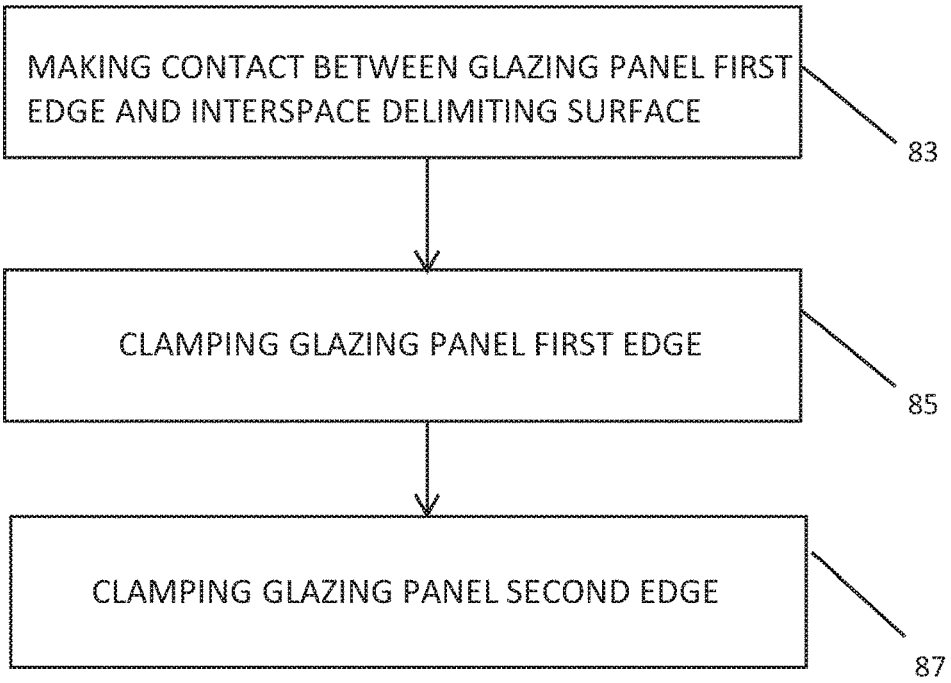
FIG. 5 is another embodiment for sealingly clamping a glazing panel.

Alternatively as shown in FIG. 5, a first edge of the glazing panel is placed in contact with a surface delimiting an interspace in step 83 and is then clamped in step 85 by the six stages. A second edge of the glazing panel opposed to the first edge is subsequently clamped in step 87.

Figure 6:
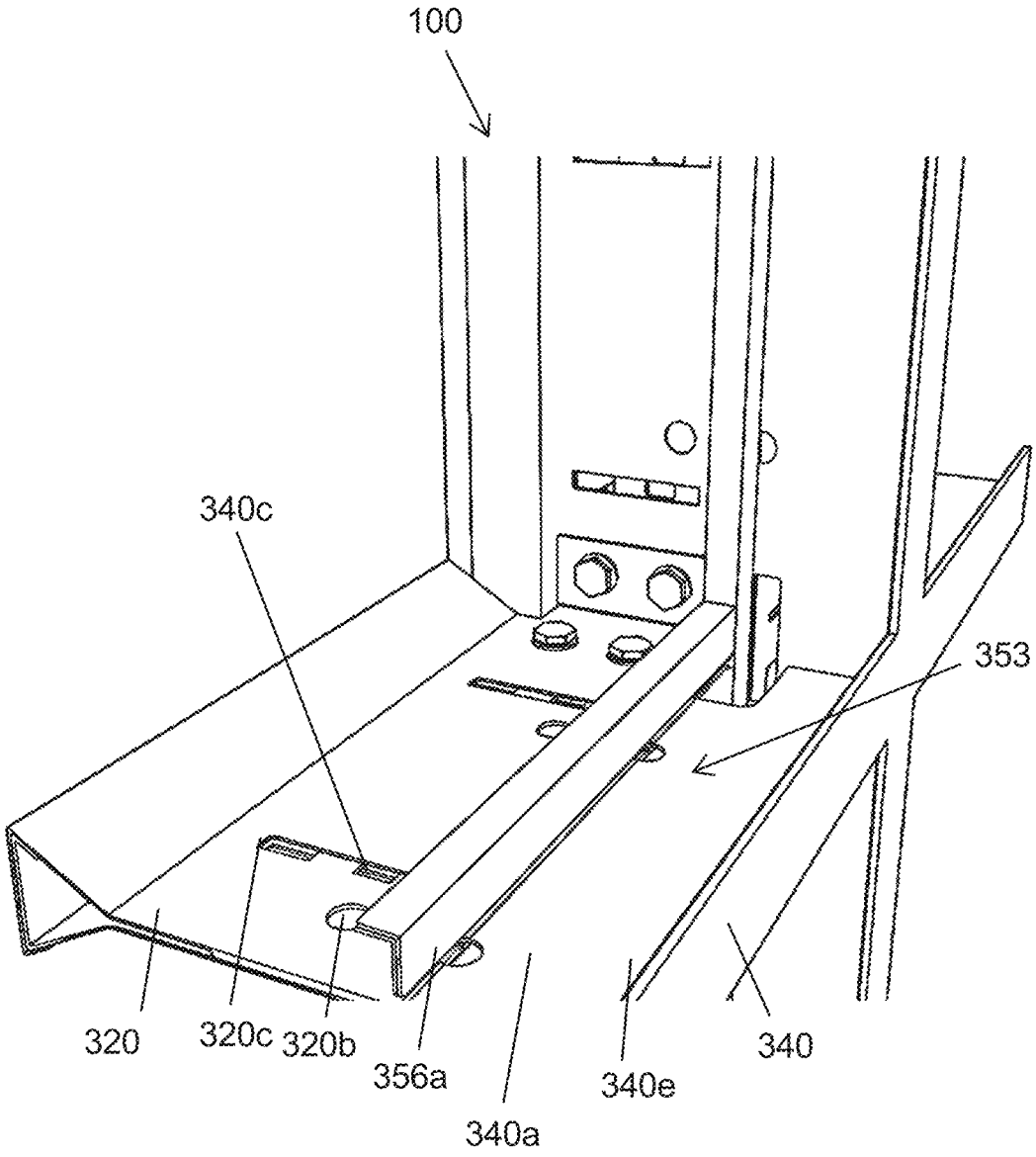
FIG. 6 is an inward perspective view of the curtain wall construction system portion of FIG. 2 when horizontally oriented clamping members have been set to an extreme clamping position with respect to corresponding support members, showing an interspace within which a set of glazing panels is introducible while the glazing panels have been removed.

FIG. 6 illustrates curtain wall construction system 100 when the clamping members 340 have been set to an extreme clamping position with respect to corresponding support members 320, shown without the glazing panels.

An interspace 353 within which a set of glazing panels is introducible during the course of a clamping operation is shown. Interspace 353 is defined by the upper shortened flange 356*a* of horizontal support member 320, and by the inner face of the upper portion of end plate 340*e* and the upper face of the protruding plate 340*a* of clamping member 340 after the latter has been introduced within the inter-web cavity of support member 320, regardless of whether protruding plate 340*a* has been initially introduced or fully introduced within the inter-web cavity.

Each circular aligning aperture 340*c* of clamping member 340 is shown to be unconstrainedly positioned within, and aligned with, a corresponding longitudinally extending elliptical aligning aperture 320*c* formed in the web of support member 320. At this initial position, protruding plate 340*a* occludes each aligning aperture 320*b* of support member 320.

Figure 7:
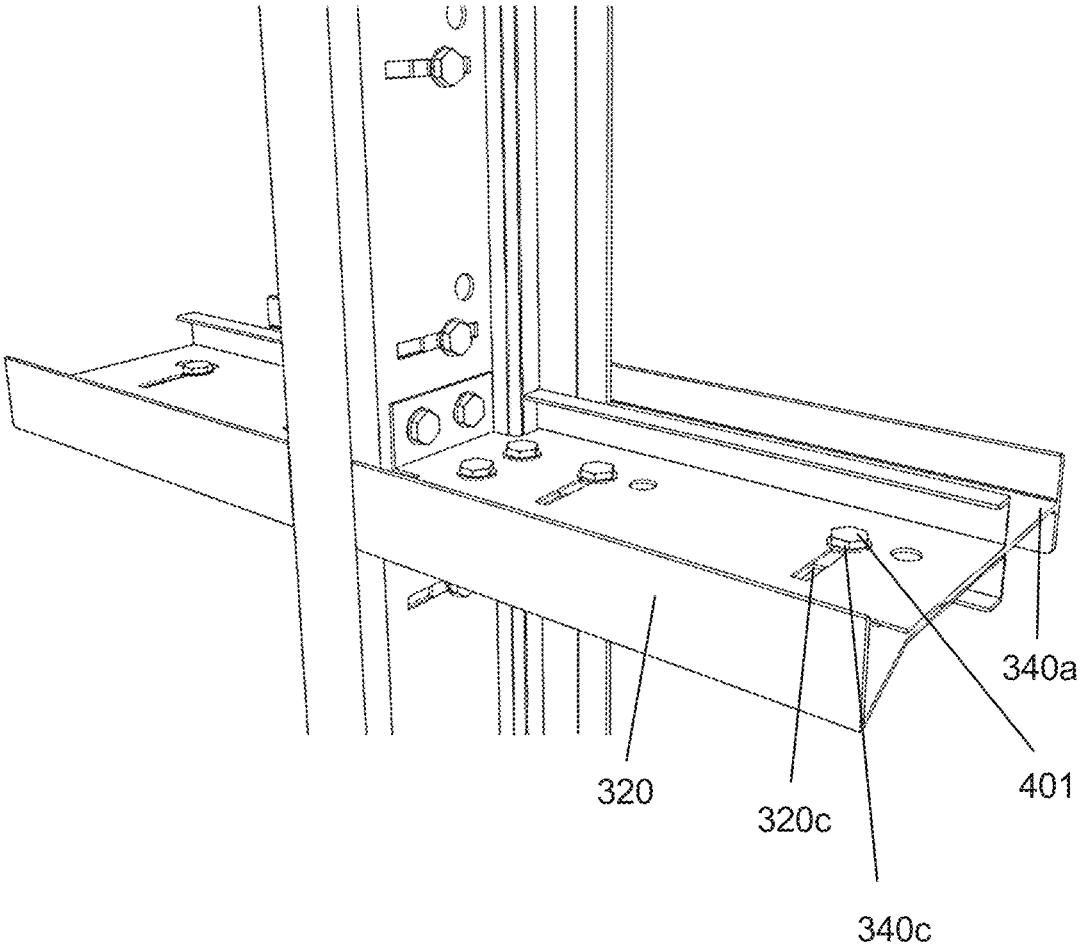
FIG. 7 is an outward perspective view of the curtain wall construction system portion of FIG. 2, showing means for urging a protruding plate to undergo linear longitudinal displacement within the inter-web cavity of a corresponding support member.

In the second stage illustrated in the outward perspective view of FIG. 7, a fastener 401 is inserted through elliptical aligning aperture 320*c* and is threadedly engaged with the edge surrounding aligning aperture 340*c*, which is located at a distal position, i.e. more distant from the interior of the room adjacent to the curtain wall. Protruding plate 340*a* is urged to undergo linear longitudinal displacement within the inter-web cavity of support member 320 by virtue of the constraint imposed by fastener 401 onto aligning aperture 340*c*.

Figure 8:
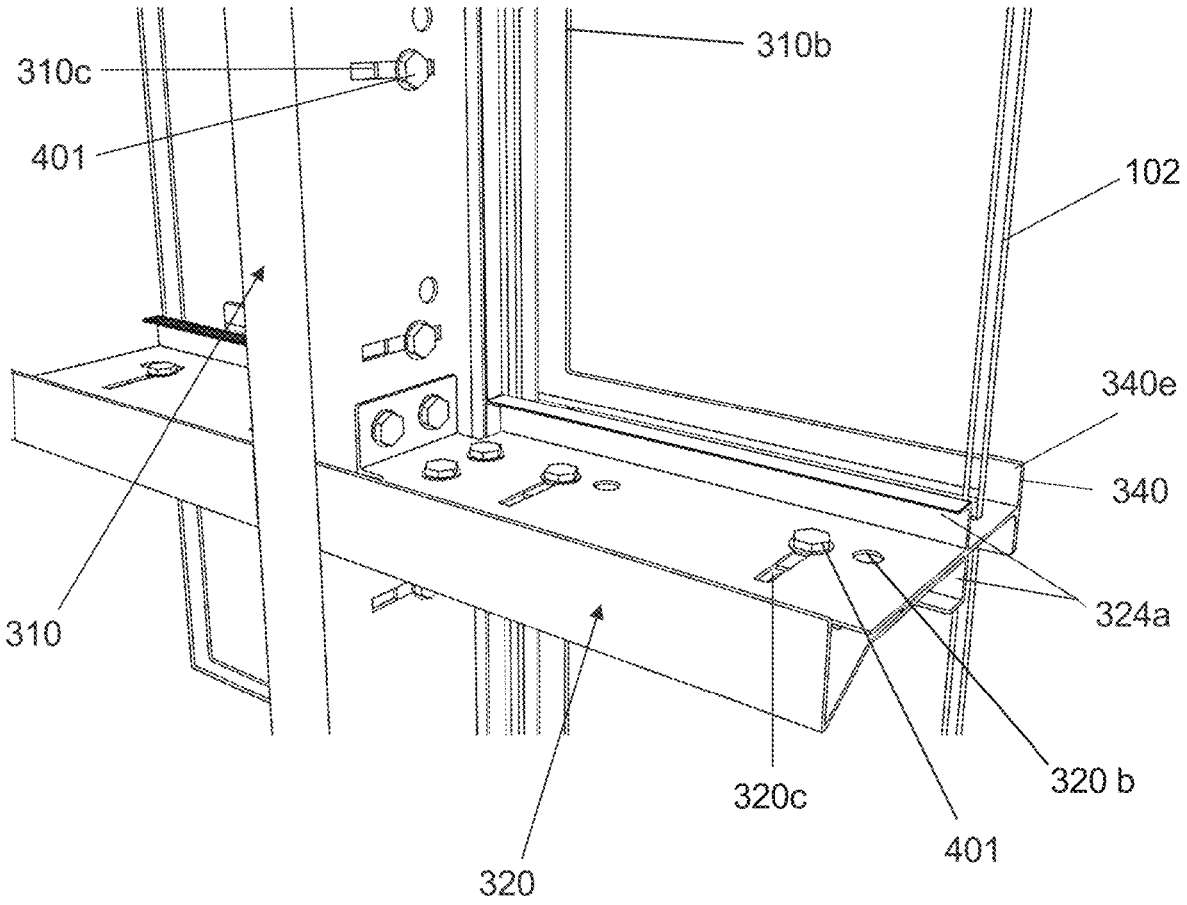
FIG. 8 is an outward perspective view of a curtain wall construction system portion, showing a set of unclamped glazing panels introduced within an interspace thereof and a horizontally oriented clamping member displaced to a more proximal position than in FIG. 7.

In the third stage illustrated in FIG. 8, the set of glazing panels 102 is inserted within the interspace. At this position, each of the glazing panels 102 is unclamped, without providing sealing protection, with the corresponding sealing element covering the upper shortened flange 324*a* of support member 320 and the inner face of the upper portion of end plate 340*e* of clamping member 340. Clamping member 340 and fastener 401 slidable along elliptical aligning aperture 320*c* are shown to be displaced to a more proximal position than that of the second stage. Also, aligning aperture 340*b* of clamping member 340 is unaligned with aligning aperture 320*b* of support member 320.

Figure 9:
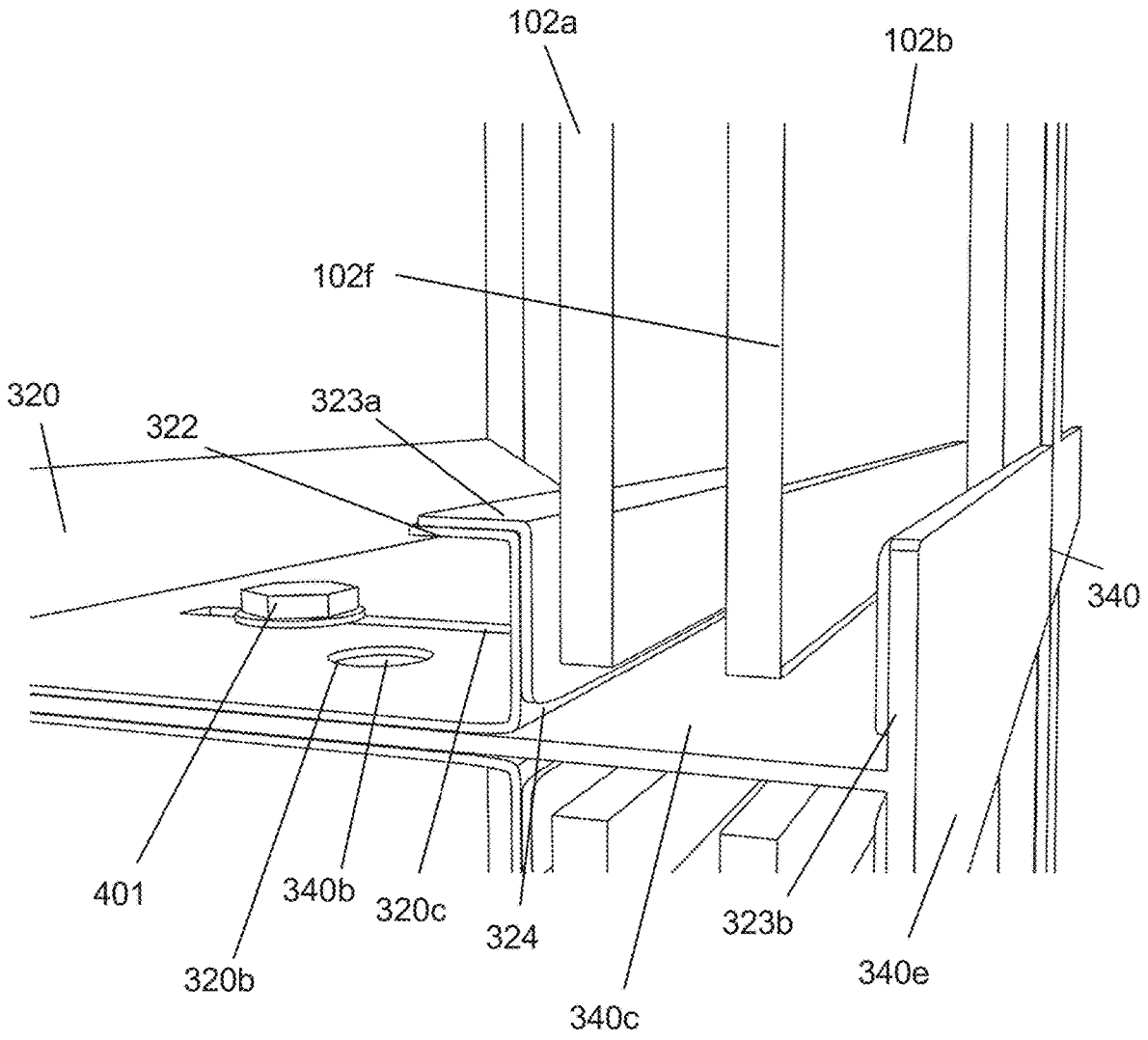
FIG. 9 is a perspective view from the side of a curtain wall construction system portion, showing a set of unclamped glazing panels positioned within an interspace thereof relative to corresponding sealing elements while a vertically oriented clamping member is removed and a horizontally oriented clamping member is displaced to a more proximal position than in FIG. 8.

In the fourth stage illustrated in FIG. 9, clamping member 340 and fastener 401 slidable along elliptical aligning aperture 320*c* are shown to be displaced to an even more proximal position than that of the third stage. The glazing panels are shown to be unclamped, with glazing panel 102*a* being in contact with L-shaped sealing element 323*a* covering the integrally formed terminal element 322 and shortened flange 324 and glazing panel 102*b* being separated from sealing element 323*b* covering the upper portion of end plate 340*e*. Even though glazing panels 102*a-b* are not supported by protruding plate 340*c*, they are stably held in position by opposed vertically oriented clamping members which clamp a corresponding glazing panel side edge 102*f*. Aligning aperture 340*b* of clamping member 340 remains unaligned with aligning aperture 320*b* of support member 320.

Although not shown, a longitudinally extending spacer connects glazing panels 102*a* and 102*b* throughout their periphery, to provide a sealed monolithic unit comprising the two glazing panels.

Figure 10:
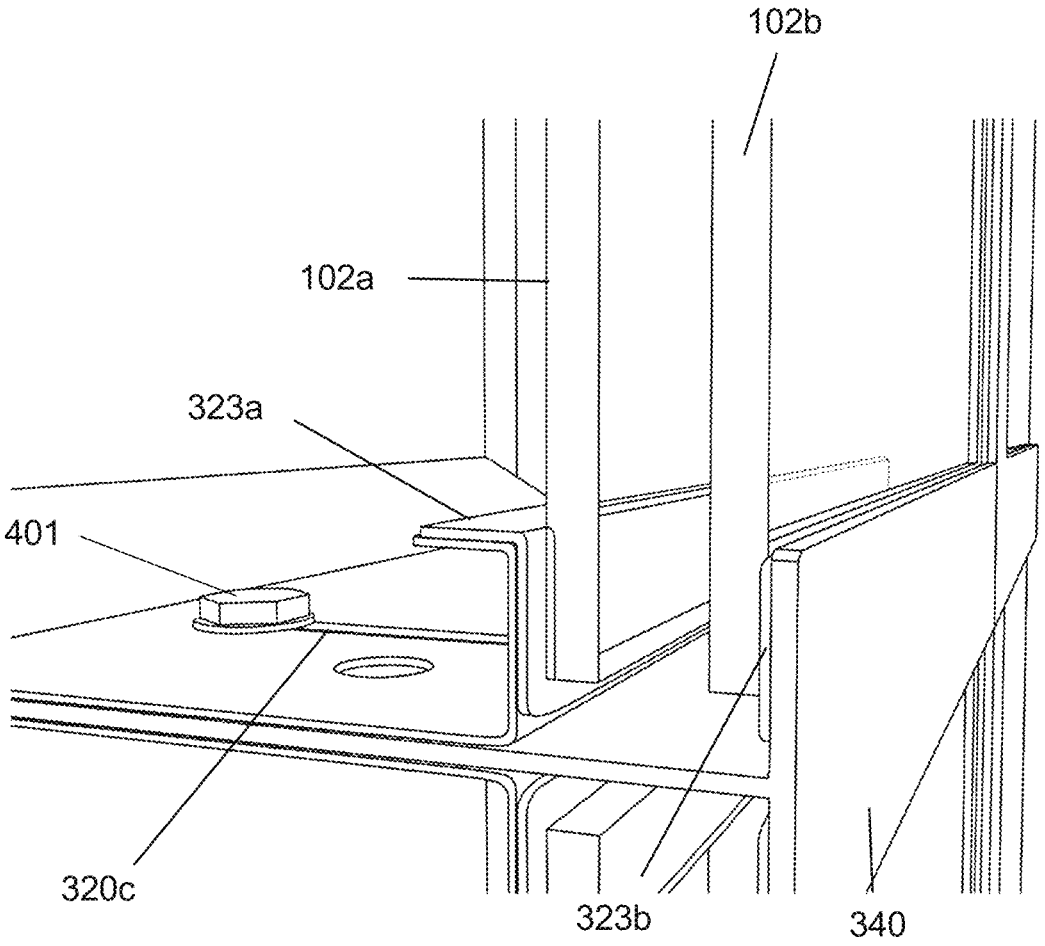
FIG. 10 is a perspective view from the side of the curtain wall construction system portion of FIG. 9, showing a set of glazing panels positioned within an interspace thereof that are in contact with corresponding sealing elements while a vertically oriented clamping member is removed and a horizontally oriented clamping member is displaced to an extreme proximal position.

In the fifth stage illustrated in FIG. 10, clamping member 340 and fastener 401 slidable along elliptical aligning aperture 320*c* are shown to be displaced to an extreme proximal position. Glazing panel 102*a* is in contact with L-shaped sealing element 323*a* and glazing panel 102*b* is in contact with sealing element 323*b*.

Figure 11:
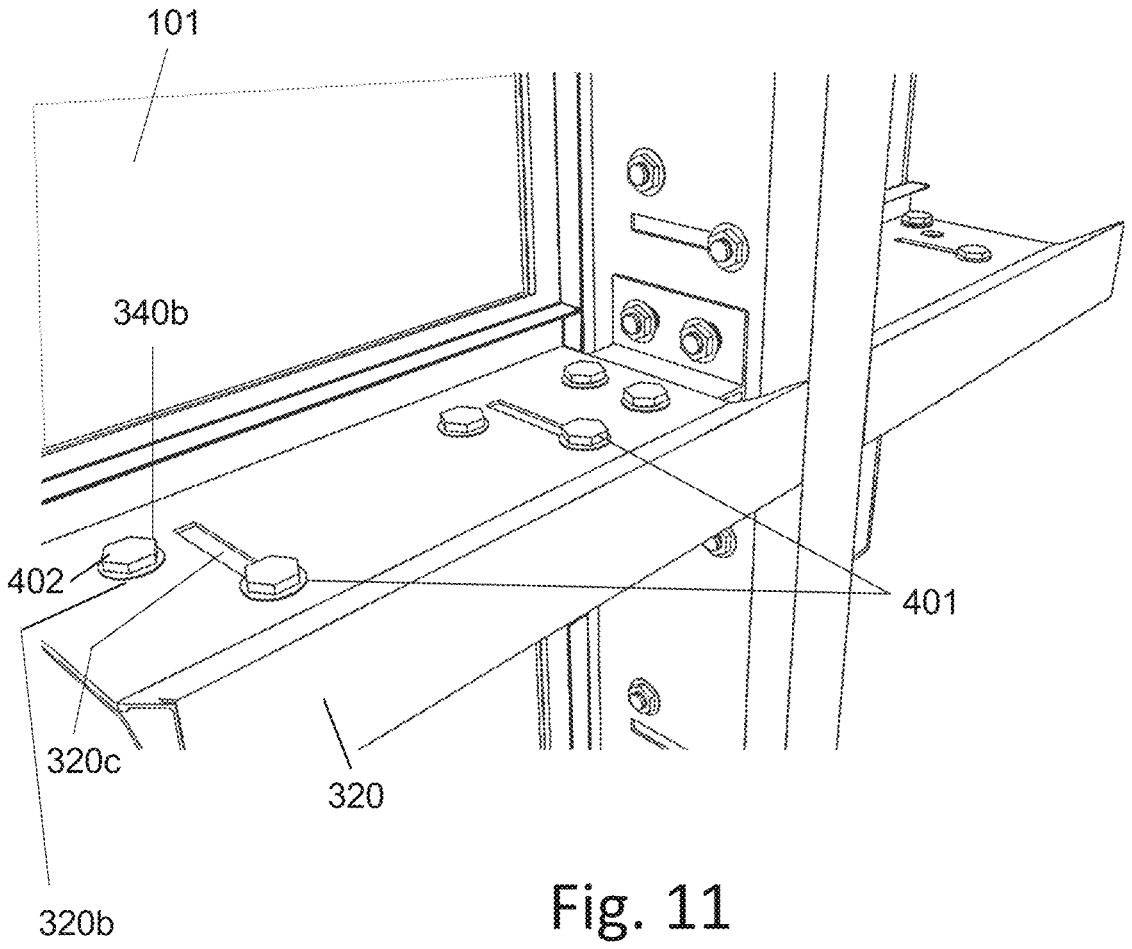
FIG. 11 is an outward perspective view of a curtain wall construction system portion, shown when the set of glazing panels is set to a clamped position.

In the sixth stage illustrated in FIG. 11, an additional proximal force is applied to the clamping member. Since fastener 401 is at an extreme proximal position relative to elliptical aligning aperture 320*c*, this additional proximal force will not be converted to proximal displacement, but rather will be transmitted by the set of glazing panels 101 to the corresponding sealing elements, which are consequently caused to deform. The sealing element deformation, usually characterized by reduced thickness and increased surface area, results in a reduced clearance relative to the corresponding glazing panel and an improved sealing protection. Following the application of this additional proximal force, the clearance between the sealing element and the abutting glazing panel is sufficiently reduced to prevent any air or moisture influx into the room interior while the two glazing panels are clamped. Also, fastener 402 is inserted through aligning aperture 340*b* of clamping member 340 and with aligning aperture 320*b* of support member 320, and is threadedly engaged with the corresponding surrounding edge. Aligning apertures 320*b* and 340*b* may be designed to be aligned only after the sealing element becomes deformed.

Figure 12:
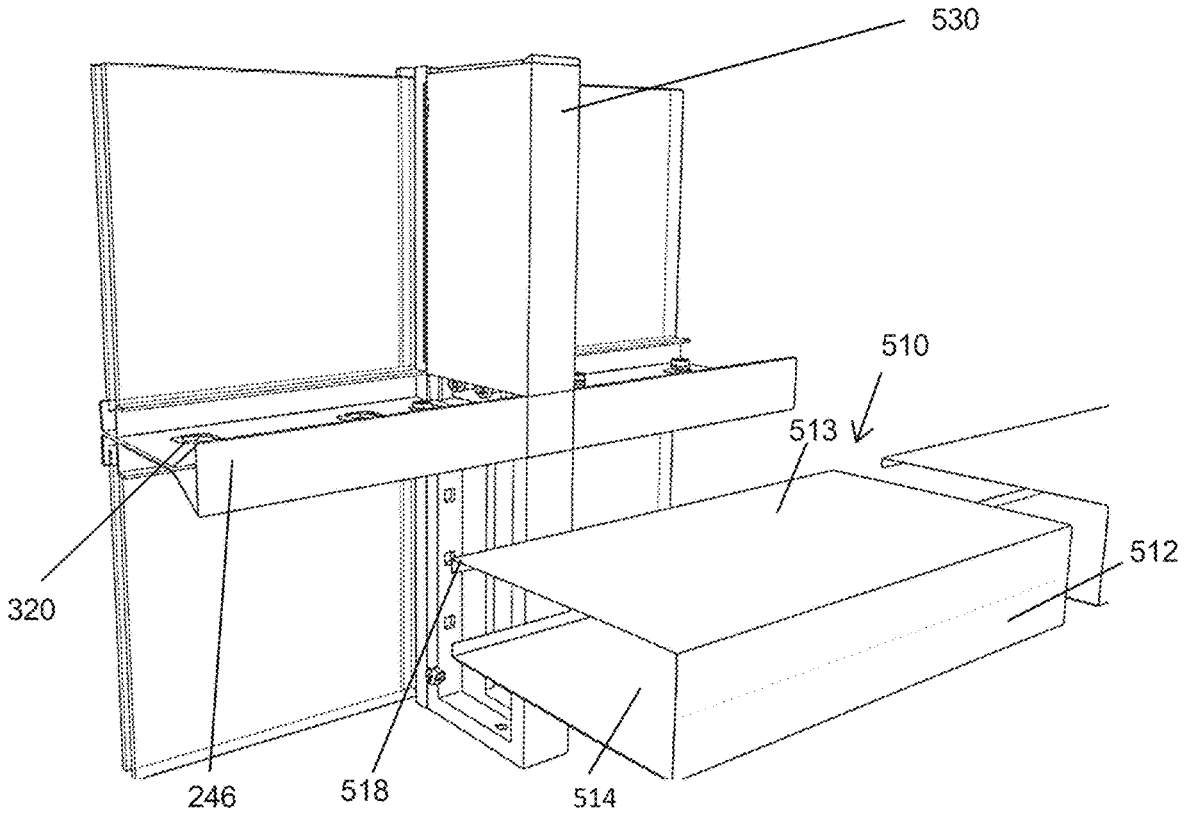
FIG. 12 is an outward perspective view of the curtain wall construction system portion of FIG. 11, showing two horizontally oriented decorative covers prior to being engaged with corresponding horizontally oriented support members
Figure 13:
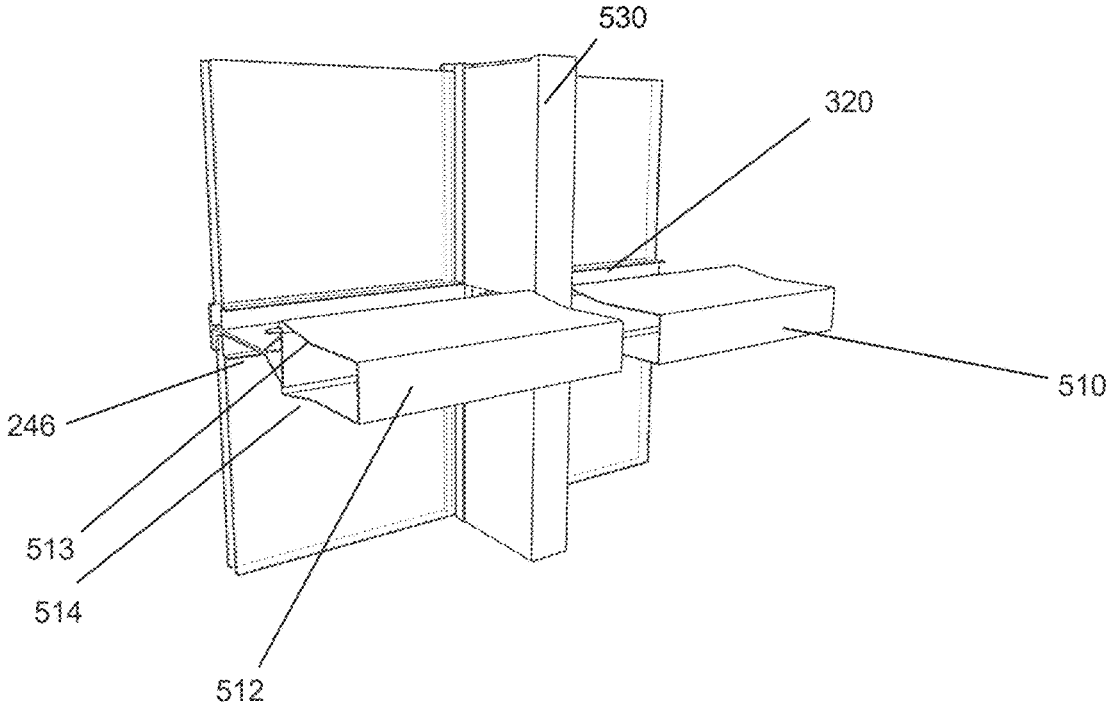
FIG. 13 is an outward perspective view of the curtain wall construction system portion of FIG. 11, shown when two horizontally oriented decorative covers are partially engaged with corresponding horizontally oriented support members.
Figure 14:
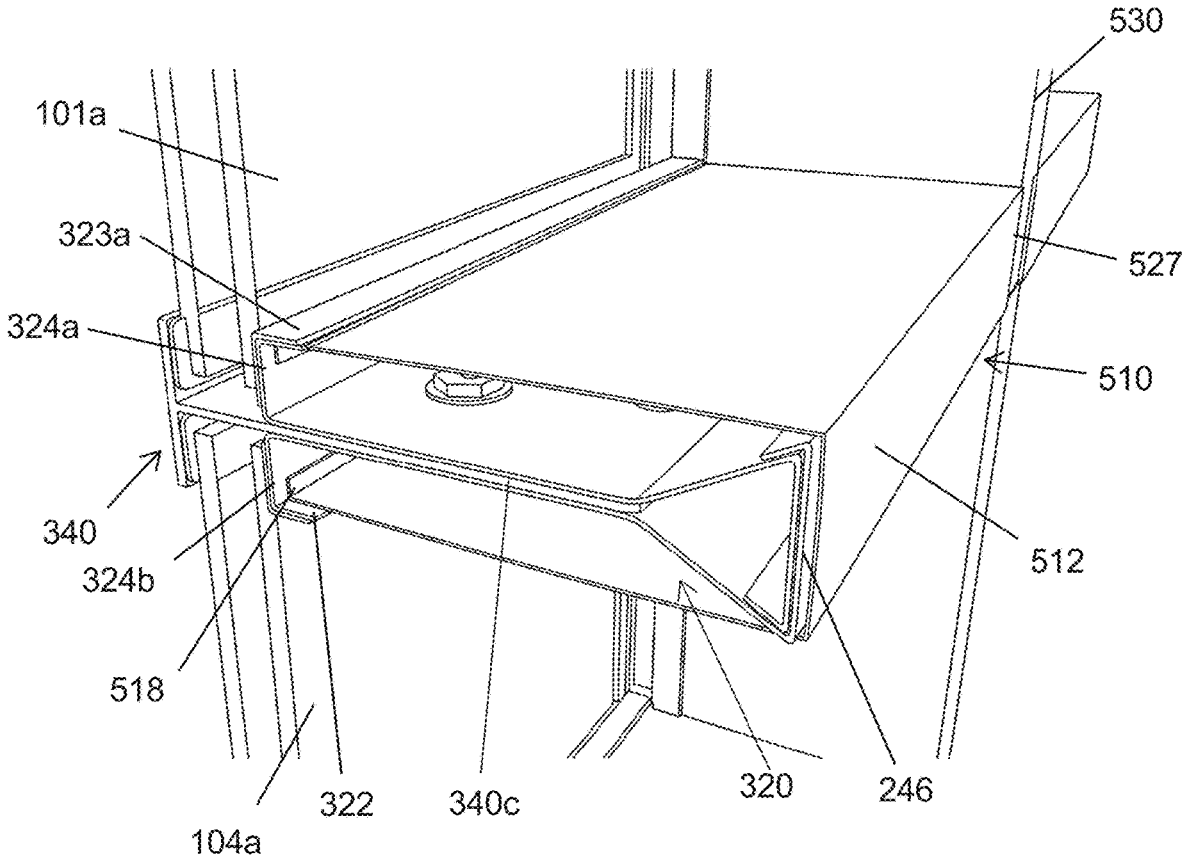
FIG. 14 is an outward perspective view from the side of the curtain wall construction system portion of FIG. 13, showing a horizontally oriented decorative cover completely engaged with a corresponding horizontally oriented support member and a clamping member protruding plate fully introduced within the inter-web cavity of the horizontally oriented support member.

After the glazing panels are clamped, a seventh stage illustrated in FIGS. 12-14 may be performed, whereby the various support members and clamping members, including the fasteners and aligning apertures, are concealed by decorative covers 510 and 530.

FIG. 12 shows two vertically oriented decorative covers 530 that are engaged with, and cover, corresponding vertically oriented support members. Two horizontally oriented decorative covers 510, identical to decorative covers 530, are shown prior to being engaged with corresponding horizontally oriented support members 320. As shown, decorative covers 510 are made of sheet metal that is bent to form a U-shaped member, such that vertical surface 512 is perpendicular to the two mutually parallel horizontal surfaces 513 and 514. A terminal element 518 laterally extends from the end of a corresponding horizontal surface, such that the two terminal elements extend towards each other, for a length significantly less than the distance between horizontal surfaces 513 and 514. The height of vertical surface 512 is substantially equal to that of flange 246 of the corresponding support member 320, and the longitudinal length of horizontal surfaces 513 and 514 is substantially equal to the longitudinal length of the corresponding support member 320.

FIG. 13 illustrates the two horizontally oriented decorative covers 510 as they are partially engaged with corresponding horizontally oriented support members 320. At this illustrated position, an intermediate region of each of horizontal surfaces 513 and 514 contacts a corresponding lateral edge of flange 246 of the corresponding support member 320. Also, a portion of a transversal edge of the upper horizontal surface 513 abuts, or is in close proximity to, a bottom edge of a corresponding vertically oriented decorative cover 530. Likewise, a portion of a transversal edge of the lower horizontal surface 514 abuts, or is in close proximity to, an upper edge of a corresponding vertically oriented decorative cover 530.

FIG. 14 illustrates the two horizontally oriented decorative covers 510 as they are completely engaged with the corresponding horizontally oriented support members 320. At this illustrated position, vertical surface 512 of a horizontally oriented decorative cover 510 is in abutment with flange 246 of the corresponding support member 320, and the two terminal elements 518 of the horizontally oriented support member are in abutment with a corresponding shortened flange 324 of a horizontally oriented support member 320 and with the corner junction adjoining the corresponding terminal element 322 of the horizontally oriented support member.

Also shown in this end view is protruding plate 340*c* of clamping member 340 when introduced to a full extent within the inter-web cavity of support member 320, urging sealing element 323*a* covering the upper shortened flange 324*a* to clamp glazing panel 101*a*, as well as the sealing element covering the lower shortened flange 324*b* of support member 320 to clamp glazing panel 104*a* covering a lower floor window opening which is located directly below, and is coplanar with, glazing panel 101*a*. A clamping operation is accordingly able to simultaneously clamp the lower edge of an upper set of glazing panels and the upper edge of a lower set of glazing panels.

Figure 15:
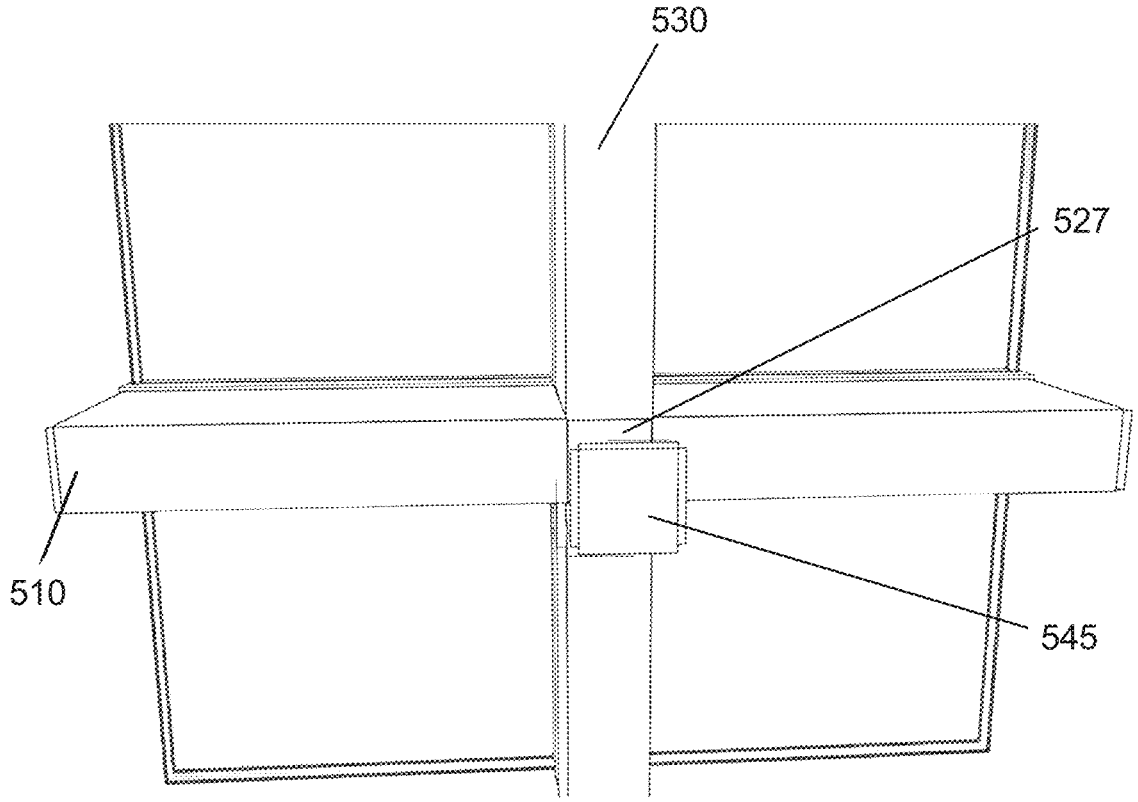
FIG. 15 is an outward perspective view of the curtain wall construction system portion of FIG. 1, showing engaged decorative covers and a planar cover prior to being adhesively affixed to a flange portion recessed from the decorative covers.

Since a flange portion 527 remains uncovered by the engaged decorative covers 510 and 530 to result in an unsightly recess, a planar cover 545 is adhesively affixed to flange portion 527 in an eighth stage illustrated in FIG. 15, to provide an esthetic and coplanar covered arrangement that is viewable from the interior of the room adjacent to the curtain wall.

FIGS. 17-20 illustrate another embodiment of a curtain wall construction system 600, which is configured to provide a curtain wall roof.

Figure 17:
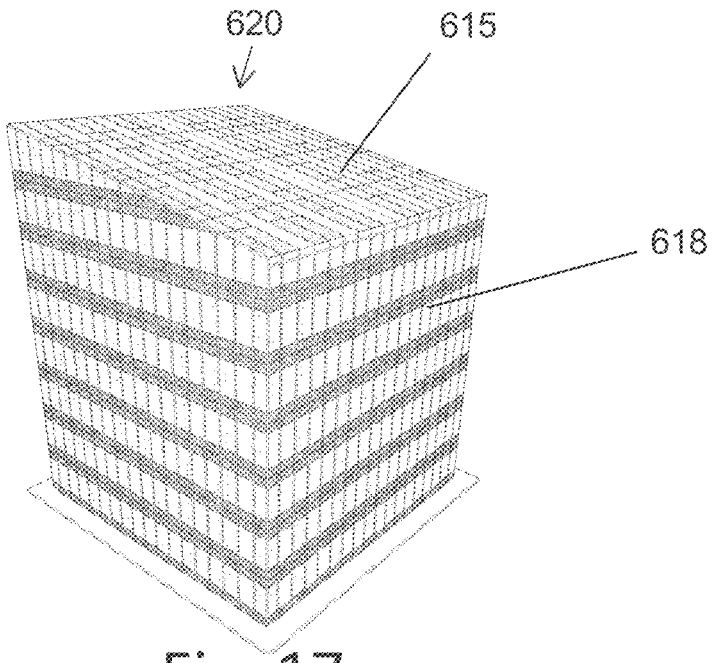
FIG. 17 is a perspective view of a building configured with a plurality of vertical curtain walls and with a curtain wall roof that are constructed according to the teachings of the invention.

A building 620 comprising the curtain wall roof 615, which may be inclined, in addition to the plurality of vertical curtain walls 618, is shown in FIG. 17.

Figure 18:
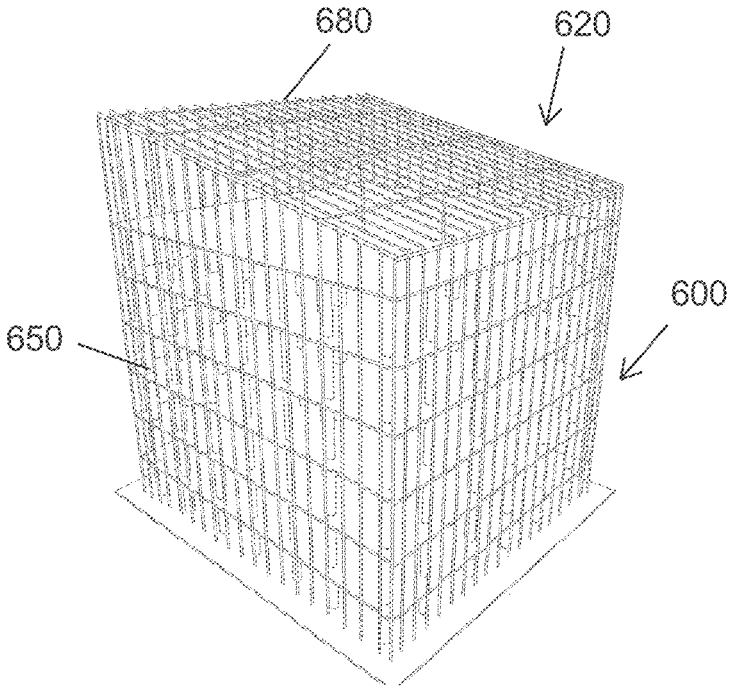
FIG. 18 is a perspective view of the building of FIG. 17, showing the curtain wall construction system while the curtain walls are removed.

Curtain wall construction system 600, used for constructing building 620 and visible when the glazing panels are removed, is shown in FIG. 18. Curtain wall construction system 600 comprises vertical curtain wall system 650 for constructing the vertical curtain walls, which is similar to system 100 that has been previously described in relation to FIGS. 1-16, and also system 680 for constructing the curtain wall roof.

Figure 19:
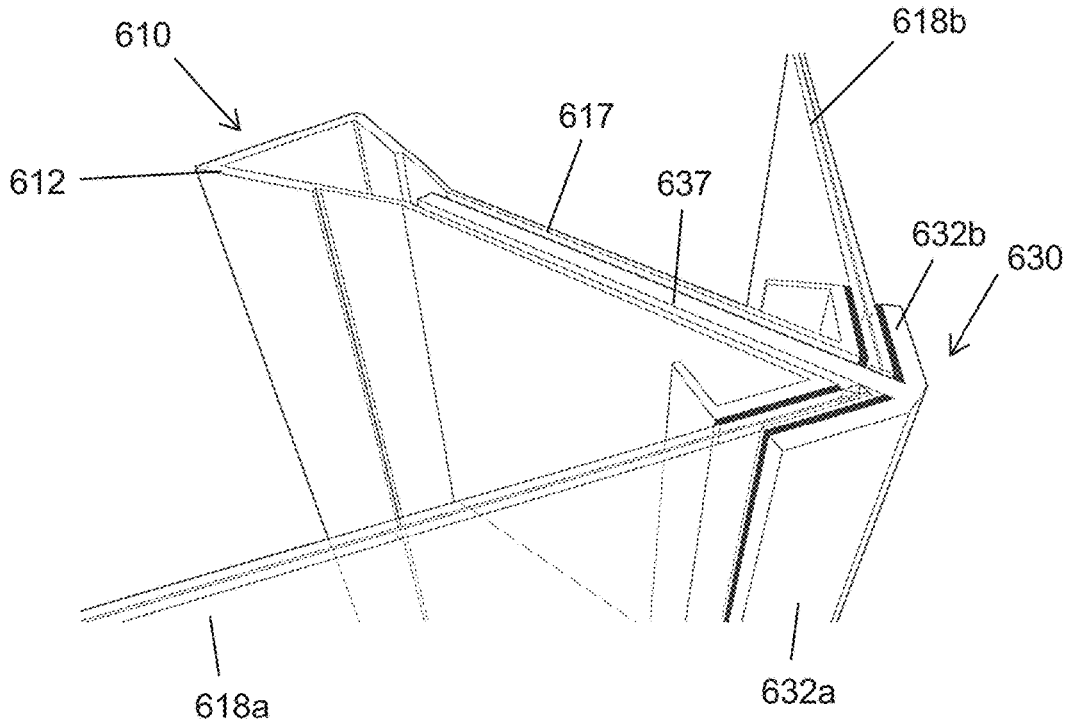
FIG. 19 is a perspective view from the side of a spaced-web support member and a cooperating clamping member according to another embodiment that are usable in conjunction with the curtain wall construction system of FIG. 18.

In order to construct two adjacent and angularly spaced curtain walls 618*a* and 618*b*, or alternatively, a vertical curtain wall and an angularly spaced curtain wall roof, spaced-web support member 610 shown in FIG. 19 may be employed. The triangularly shaped head portion 612 and webs 617 of support member 610 may be configured similarly to spaced-web support member 220 of FIG. 16 with two identical oppositely oriented sheet metal pieces that are nested one within the other, or alternatively support member 610 may be made of a single metal piece. It will be appreciated that support member 220 may be also made of a single metal piece.

Clamping member 630 has two end plates 632*a* and 632*b* that are angularly spaced from each other by the same angle by which curtain walls 618*a* and 618*b* are angularly spaced. Protruding plate 637 extends from the junction of end plates 632*a* and 632*b*, bisecting the angle therebetween so as to be able to be introduced within the inter-web cavity of support member 610.

Each shortened flange 616 of spaced-web support member 610 is angularly spaced from the corresponding web 617 by an angle that enables shortened flange 616 to be parallel to a corresponding end plate and the corresponding glazing panel to be suitably sealingly clamped in accordance with the six stages described in relation to FIGS. 6-11.

Figure 20:
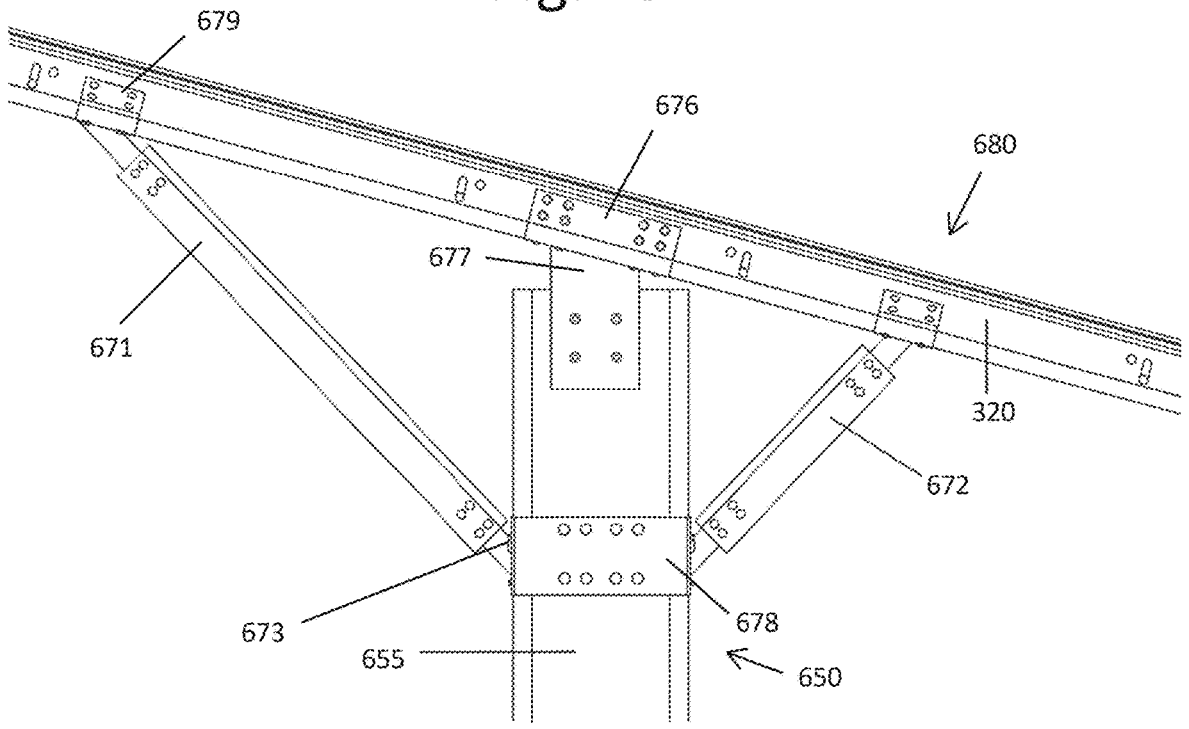
FIG. 20 is a front view of a main support beam of a vertical curtain wall system, showing an exemplary interconnection with a support beam of a curtain wall roof system that is usable in conjunction with the curtain wall construction system of FIG. 18.

As shown in FIG. 20, curtain wall roof system 680 is connected to vertical curtain wall system 650 by a plurality of oblique support members 671-672 and dedicated connectors 676-679. Vertical curtain wall system 650 comprises a plurality of vertically oriented main support members 655 that are each configured with two opposed triangularly shaped head portions providing increased strength, between which the web extends. A main support member 655 may also be a spaced-web support member, being configured similarly to support member 220 of FIG. 16, but being provided with a second triangular head portion in lieu of the tail portion. Oblique support members 671-672 are also configured with two triangular head portions and have transversal extensions 673 that are each connected to the oblique support member web.

Connectors 676-679 are metallic pieces that are preshaped to facilitate engagement with the triangular head portions, such as with cold fasteners or alternatively by welding. These angled connectors serve to transmit shear forces between the web of the first beam to a web of a second beam, or between the flange of the first beam to the flange of a second beam, even when the beam is galvanized or painted, resulting in reduced-magnitude moments at a moment connection.

Curtain wall roof system 680 comprises a plurality of spaced-web support members 320 that are each positioned obliquely with respect to the main support members 655. Some of support members 320 intersect other support members so as to define rectangular openings within each of which a set of glazing panels is receivable and clampable by a corresponding clamping member as described above.

Connector 676 is connected to the web of support member 320 and embraces the single triangular head portion thereof. Connector 677 is connected to the transversal end of the web of a main support member 655 and to connector 676 at the flange of support member 320. Connector 678 longitudinally extends along the web of main support members 655 and embraces its two triangular head portions. A lower extension 673 of oblique support members 671 is connected with one end of connector 677 at a first flange of main support member 655, and an upper extension of oblique support member 671 is connected to one side of connector 679 which is connected to the web of support member 320. Shortened oblique support member 672 is similarly connected to main support member 655 at a second flange thereof and to support member 320.

Figure 21:
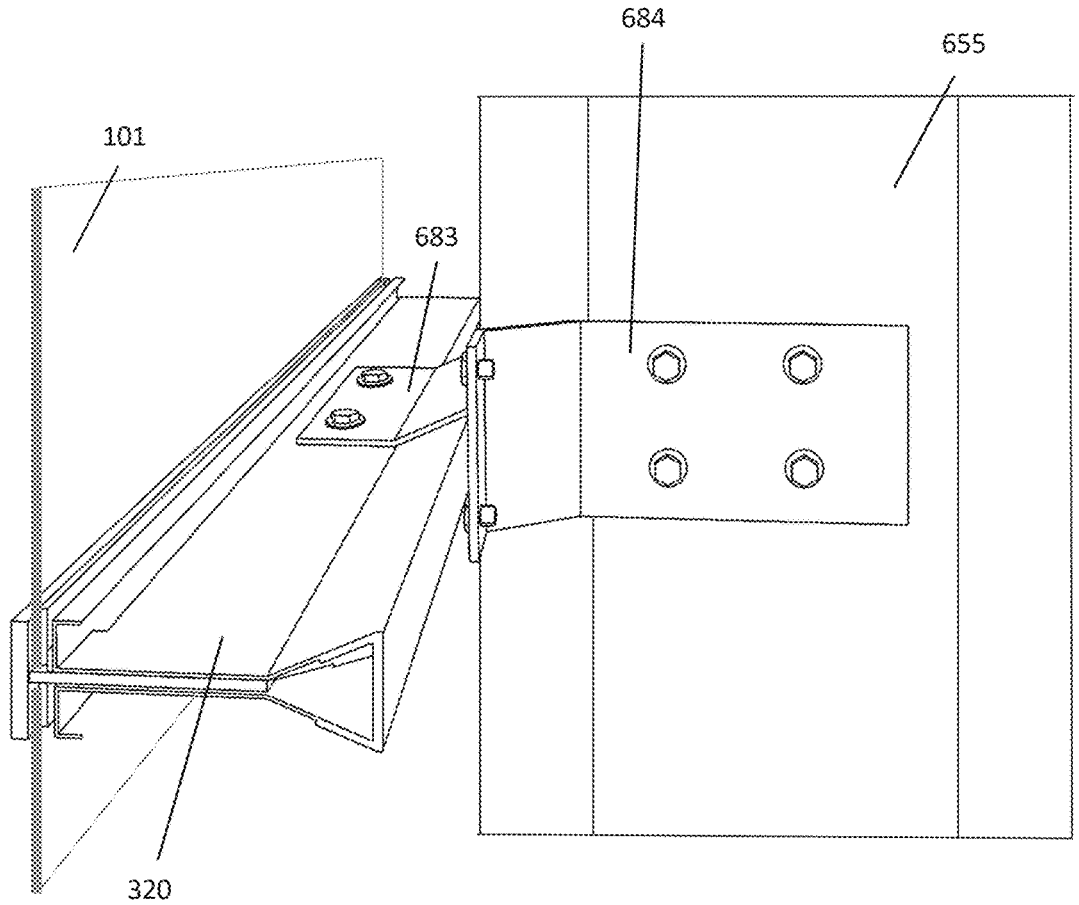
FIG. 21 is a perspective view from the front of a main support member that is usable in conjunction with the curtain wall construction system of FIG. 18, showing a longitudinally connected vertical curtain wall support member.
Figure 22:
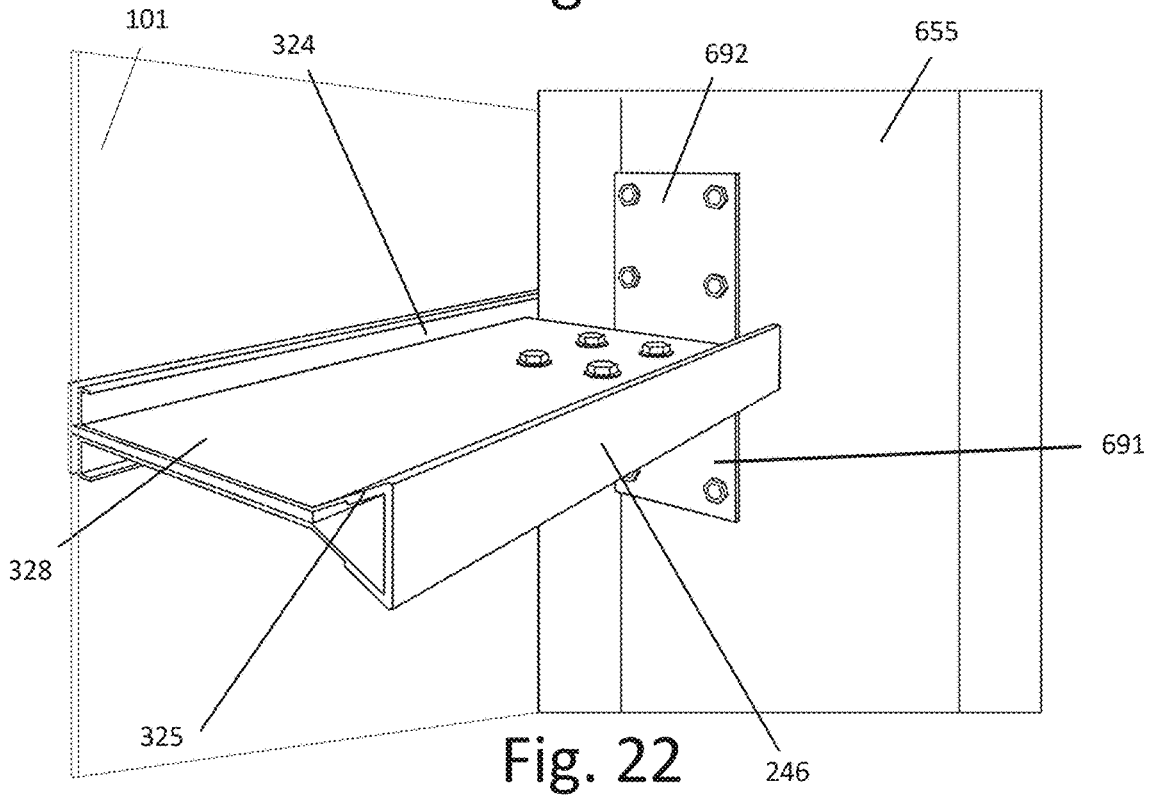
FIG. 22 is a perspective view from the front of a main support member that is usable in conjunction with the curtain wall construction system of FIG. 18, showing a laterally connected vertical curtain wall support member.

FIGS. 21 and 22 illustrate different possibilities of mounting a vertical curtain wall with respect to a main support member.

In FIG. 21, horizontal support member 320 to which glazing panel 101 is clamped is longitudinally connected to vertically oriented main support member 655 by connector 683 longitudinally extending along the web and an oblique head portion element of support member 320. Connector 683 is connected to the web of support member 320, and a vertical element of connector 683 engaged with the flange of support member 320 is connected to a portion of a vertical end plate of connector 684 which protrudes laterally from the adjacent flange of main support member 655. A metallic plate of connector 684 is connected to the web of main support member 655 and longitudinally extends to the end plate.

In FIG. 22, horizontal support member 325 to which glazing panel 101 is clamped is laterally connected to vertically oriented main support member 655 by L-shaped connector 691. One leg of connector 691 is connected to web 328 of support member 325, and the other leg is connected to transversally extending planar connector 692, which is connected to the web of main support member 655.

In order to accommodate the lateral protrusion of a triangular head portion of main support member 655 while being laterally connected to its web, web 328 of support member 325 is configured with a shorter length than its head portion flange 246 and tail portion flange 324. With the exception of the shorter transversal dimension of web 328, support member 325 is configured identically to support member 320 of FIG. 21.

Figure 23A:
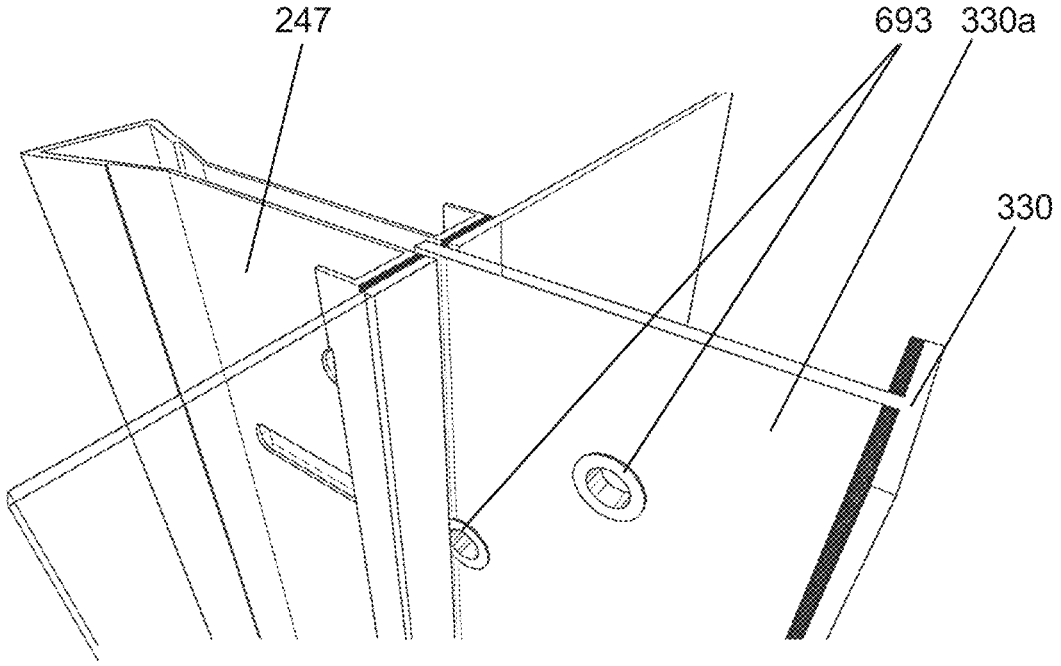
FIG. 23A shows an embodiment according to which, a heat insulating spacer is inserted into each of the aligning apertures formed in the protruding plate of clamping member.

FIG. 23A shows an embodiment according to which, a heat-insulating spacer 693 is inserted into each of the aligning apertures 310*b*, 330*b* and 330*c*, formed in the protruding plate 330*a* of clamping member 330. The insulating spacers 693 create an air gap between the protruding plate 330*a* of clamping member 330 and each face of the disposed web 247, so as to prevent heat transfer from the protruding plate 330*a* (which is heated by the outer face of the end plate clamping member 330, as this outer face is exposed to solar radiation during the day) to the disposed web 247. Such heat transfer should be prevented, otherwise, each web will radiate heat into the interior of the building.

Figure 23B:
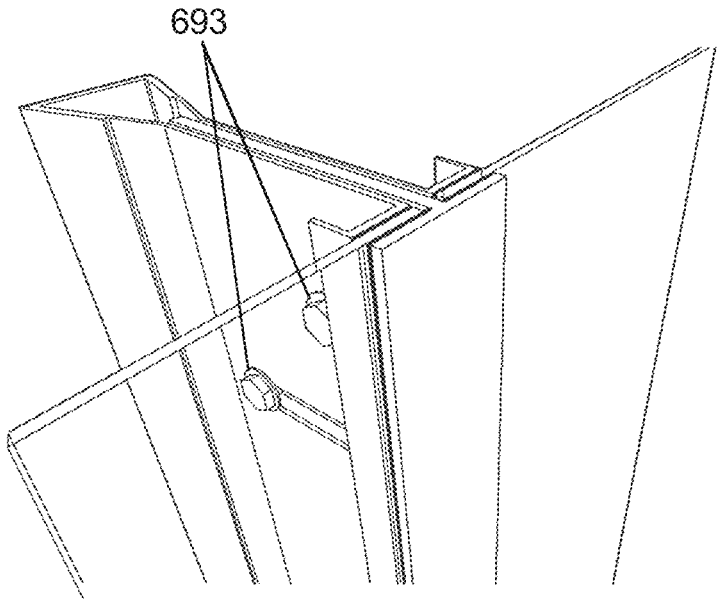
FIG. 23B shows the insulating spacers when the disposed web and the clamping member are clamped to each other.

FIG. 23B shows the insulating spacers 693 when the disposed web 247 and the clamping member 330 are clamped to each other.

The same applies also to the horizontally oriented clamping member and their corresponding horizontally oriented support members.

In one embodiment, each beam of the curtain wall also constitutes a structural element of the building being constructed, for example, a building of limited height. In this fashion, significant construction time is significantly reduced relative to the prior art practice of constructing the curtain wall and attaching the same to the building skeleton after the latter has been constructed, since the structurally strong building skeleton and the curtain wall are advantageously able to be constructed at substantially the same time to significantly reduce manpower.

Although embodiments of the invention have been described by way of illustration, it will be understood that the invention may be carried out with many variations, modifications, and adaptations, without exceeding the scope of the claims.

The invention claimed is:

1. A curtain wall construction system, comprising:

a) a plurality of interconnected curtain wall supporting beams;

b) one or more elongated and compressible sealing elements attached to at least one of the curtain wall supporting beams, wherein said curtain wall construction system is configured with a dedicated interspace within which a corresponding set of one or more rigid and impermeable panels is introducible, said curtain wall construction system further comprising:

c) a linearly displaceable clamping element that is clampable against the introduced set of panels to form a clamping arrangement which provides sealing protection in conjunction with the one or more sealing elements, wherein each of the interconnected curtain wall supporting beams is a spaced-web support member, and the clamping element includes a clamping member configured with a protruding plate which is capable of being received within an inter-web cavity between two laterally spaced webs of one of the spaced-web support members, wherein the spaced-web support member comprises a single two-layered triangularly shaped head portion.

2. The curtain wall construction system according to claim 1, wherein the spaced-web support member comprises a visual indicator that facilitates directing the protruding plate of a clamping member longitudinally through the inter-web cavity and towards the head portion.

3. The curtain wall construction system according to claim 1, further comprising a coupling bracket for interconnecting two of the beams by a moment connection.

4. The curtain wall construction system according to claim 1, wherein the clamping member is T-shaped.

5. The curtain wall construction system according to claim 1, wherein each of the clamping members and spaced-web support members is configured with an aligning aperture for use in visually determining a final clamping alignment of the protruding plate.

6. The curtain wall construction system according to claim 1, further comprising one or more angled connectors by which each of the spaced-web support members is connected to a main support member.

7. The curtain wall construction system according to claim 6, wherein each of the main support members has two opposed triangularly shaped head portions.

8. The curtain wall construction system according to claim 1, wherein each of the panels is a glazing panel or a solar panel.

* * * * *